US006598552B1

(12) United States Patent
Rouse

(10) Patent No.: US 6,598,552 B1
(45) Date of Patent: Jul. 29, 2003

(54) PONTOON HAVING A CROSS SECTION WITH A NON-UNIFORM DIAMETER AND BOAT HAVING SAME

(76) Inventor: Richard W. Rouse, 28544 E. River Bay Dr., Waterford, WI (US) 53185

( * ) Notice: Subject to any disclaimer, the term of this patent is extended or adjusted under 35 U.S.C. 154(b) by 0 days.

(21) Appl. No.: 10/193,592

(22) Filed: Jul. 11, 2002

(51) Int. Cl.[7] ..... B63B 1/12

(52) U.S. Cl. ..... 114/61.2; 114/292; 441/44; 441/45

(58) Field of Search ..... 114/61.1, 61.2, 114/283, 292, 39.26; 441/44, 45

(56) References Cited

U.S. PATENT DOCUMENTS 404,150 A * 5/1889 Ammen ..... 441/45
1,173,544 A * 2/1916 Vialet-Chabrand ..... 441/45
2,685,270 A * 8/1954 Pieraccioni Dit Pierac . 114/283
2,717,849 A * 9/1955 Rempel et al. ..... 156/69
3,614,937 A * 10/1971 Schulman ..... 114/283
4,919,632 A * 4/1990 Smith et al. ..... 441/44
5,191,848 A * 3/1993 Hatfield ..... 114/61.2
5,435,260 A 7/1995 Granie et al.
5,988,087 A 11/1999 Pepper

OTHER PUBLICATIONS

Playbuoy Pontoon Manufacturing, Inc., *Eagle Angler 18' 20' & 22'* , http://www.playbuoy.com/2001%20web%20page/1e_angler.htm, (date unknown).

* cited by examiner

*Primary Examiner*—Sherman Basinger
(74) *Attorney, Agent, or Firm*—Boyle Fredrickson Newholm Stein & Gratz S.C.

(57) ABSTRACT

A pontoon includes an elongated body of non-uniform diameter. The body is dimensioned and configured to provide a non-uniform buoyant force to a boat along at least a majority of a length of a boat. Also provided is a pontoon boat including pontoons as described above. The pontoon boat also includes a deck having an upper surface and a lower surface. The pontoons are attached to the lower surface of the deck.

23 Claims, 3 Drawing Sheets

PONTOON HAVING A CROSS SECTION WITH A NON-UNIFORM DIAMETER AND BOAT HAVING SAME

BACKGROUND OF THE INVENTION

1. Field of the Invention

The invention relates to floatation devices, and more particularly to pontoons for floating boats and boats having pontoons.

2. Description of the Related Art

Boats are used for a variety of purposes, including recreation, transportation, fishing, camping, and socializing. Pontoon boats are popular for these uses and are preferred by some boaters because of their relative stability and their capacity to accommodate many people.

Pontoon boats have a keel, which is a main structural member that runs lengthwise along a centerline from a bow portion (front) to a stern portion (rear) of the boat. Pontoon boats normally have a shallow draft. That is, the depth of the keel of the pontoon boat below the water line is shallow. In addition, pontoon boats typically include a generally flat deck that is supported on airtight floatation tubes, i.e., pontoons. A nose cone is located at the front of the pontoon to help the boat glide forwardly through water. Conventional pontoons have a cross section with a fixed diameter. As a result, the pontoon's load supporting capacity is constant along the length of the pontoon. Pontoons with fixed-diameter cross sections therefore can keep a pontoon boat afloat in a generally horizontal orientation if the weight of the boat and its occupants are relatively equally distributed along the length of the pontoon.

The deck supports furniture, engine, fuel, and often additional items such as fishing equipment, coolers. The engine, typically comprising a relatively heavy 75 to 115 horsepower engine, is mounted on or near the stern of the boat. The fuel tank, often weighing several hundred pounds when full, is usually located near the engine. Therefore, even without including passengers, the majority of the weight is concentrated in the back of the boat.

Pontoon boats usually include seating for multiple passengers. This seating is typically concentrated at the stern. The suggested maximum number of persons for a typical 18-foot boat is 8 people, with a maximum of 12 people on a typical 22-foot boat. Considering that an average person weighs about 150 pounds, eight people, on average, weigh 1,200 pounds and twelve people, on average, weigh 1,800 pounds. The maximum weight capacity for a typical 18-foot boat is 1,900 pounds, for a typical 20-foot boat, is 2,155 pounds, and for a typical 22-foot boat is 2,400 pounds. Although the weight of the people alone can be carried by these boats, it is difficult for a pontoon boat to accommodate this weight when it is concentrated in one area of the boat. In particular, it is difficult for a pontoon boat to support many people at the stern, where people tend to congregate both because of the design of the boat and because the ride tends to be smoother at the stern. Many boats include a table along with seating at the stern, and many people prefer to sit around a table. Having people assemble at the stern places the majority of the load at the stern. As discussed above, this load concentration near the stern is compounded by the fact that weight of the engine, furniture, and fuel, which are also at the stern, must also be borne by it. In addition, the captain's chair is at the rear of the boat. When enough weight is loaded at the stern, a conventional pontoon boat no longer rides generally horizontally in the water. Instead, the boat lifts toward the stem. This causes several problems. For instance, the ride becomes rougher when the bow is further out of the water. In addition, lifting of the boat makes it difficult to stand or walk. Items may also slide off tables or shelves. Additionally, when the lift towards the stern is extreme, the engine can become submerged, causing failure of the engine.

Thus, there is a need for a pontoon that avoids at least some of the problems noted above. In particular, the pontoon should compensate for uneven load distribution along the length of the boat. The pontoon preferably should also be retrofitable onto an existing boat. Furthermore, there is a need for a boat having pontoons that compensate for greater weight in the stem of the boat.

SUMMARY OF THE INVENTION

The invention, which is defined by the claims set out at the end of this disclosure, is intended to solve at least some of the problems noted above.

In accordance with a first aspect of the invention, a pontoon is provided. The pontoon includes an elongated body of non-uniform diameter. The body is dimensioned and configured to provide a non-uniform buoyant force along at least a majority of a length of a boat in order to accommodate an uneven load distribution on the boat.

In one preferred embodiment, the body has a front end and a rear end, and the body is tapered in cross-sectional diameter along at least a substantial portion of the length thereof. The pontoon may include a generally cylindrical body that may have an elongated portion cut away or omitted to define an elongated flat wall that is attachable to a lower side of a deck of the boat.

Also provided is a pontoon boat that includes the pontoons having an elongated body of non-uniform diameter. The pontoon boat also includes a generally flat deck having an upper surface and a lower side. The pontoons are attached to the lower surface of the deck.

DETAILED DESCRIPTION OF THE PREFERRED EMBODIMENT

1. Resume

Figure 1:
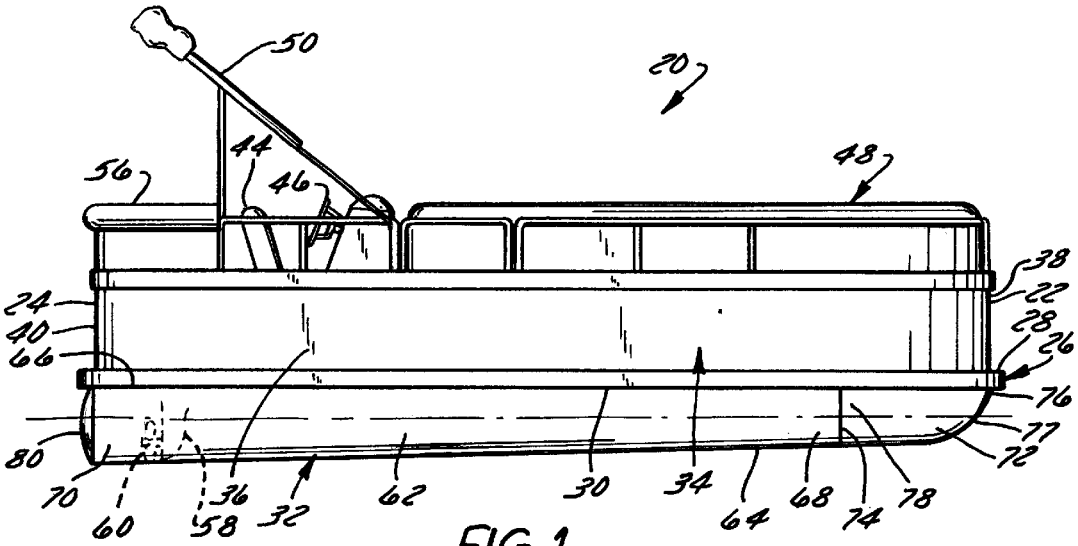
FIG. 1 a side elevation view of a boat made in accordance with a preferred embodiment of the invention.

Pursuant to a preferred embodiment of the invention, a pontoon is provided that is tapered. The pontoon has a cross section with a smaller diameter at one portion of the pontoon than another portion in order to accommodate uneven load distribution along the includes a raised sun deck 56 behind the captain's chair 44 for sitting or lying in the sun. Finally, an engine 58 is mounted on the stem 24 of the boat 20 and supplies power to a propeller 60.

Figure 4:
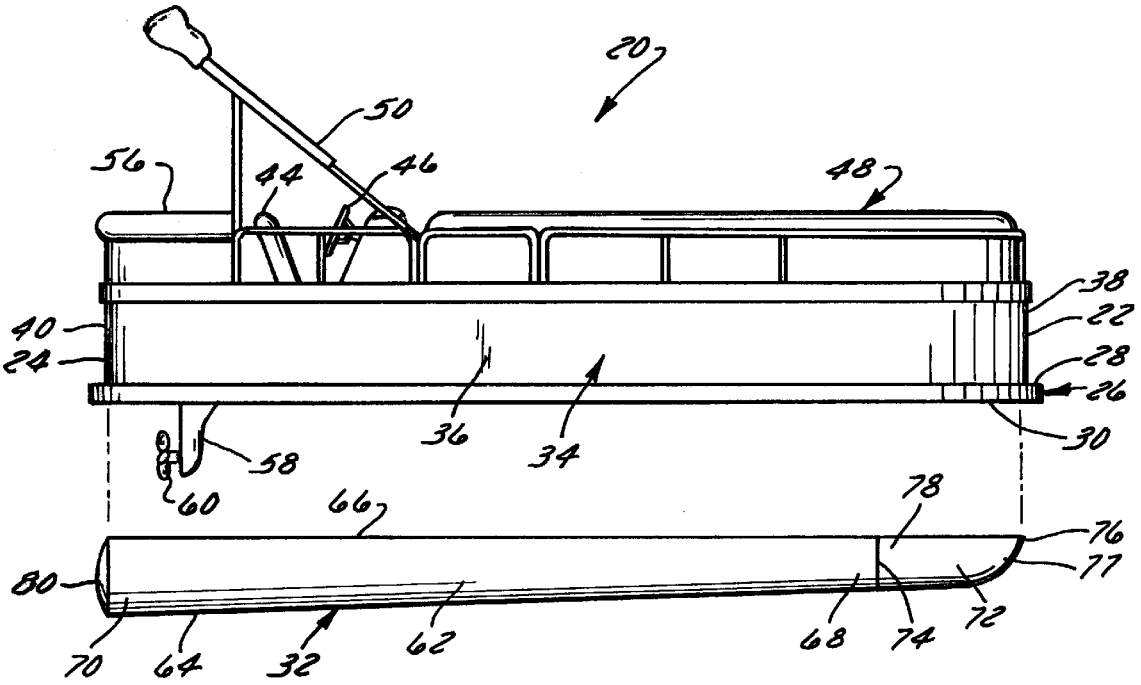
FIG. 4 is an exploded view of the pontoon boat for FIGS. 1–3, showing the pontoon detached from the boat.
Figure 5:
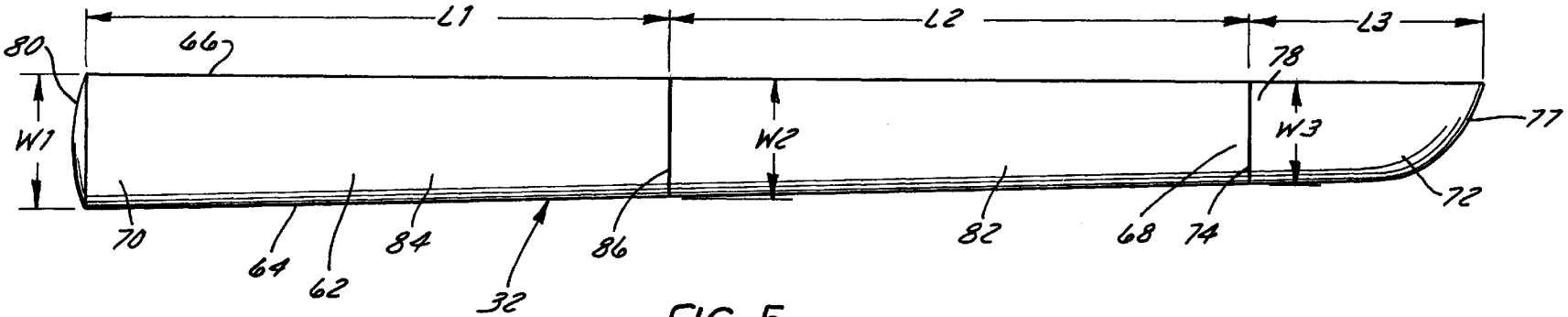
FIG. 5 is a side elevation view of a pontoon made in accordance with another preferred embodiment of the invention, showing a nose cone, a fore-section, and an aft section of the pontoon.

Two pontoons 32 are provided in the illustrated embodiment, oriented generally parallel to one another and extending longitudinally of the boat 20. One or more additional pontoons 32 can be added. For example, a third pontoon 32 can be added between two pontoons 32, which can be located along outer sides of the boat 20. Pontoons 32 may be fabricated form a material such as aluminum or any other material commonly used in pontoons. Each pontoon 32 has a non-uniform diameter so as to have greater load bearing capacity at the portion(s) of the boat 20 where the load is more heavily distributed. That portion is the stem 24 in the illustrated embodiment. In a preferred embodiment, each pontoon 32 includes an elongated body 62 having a lower wall 64 that is partially cylindrical in shape and an upper wall 66 that is generally flat, as is best seen in FIGS. 4 and 5. The body 62 is dimensioned and configured to provide variable buoyant force to a boat 20 along at least a majority of a length of the boat. Each pontoon 32 is attached to the lower surface 30 of the deck 26 at the generally flat, upper wall 66 of the body 62. When the pontoon boat 20 is in use, at least a portion of the partially cylindrical, lower wall 64 is submerged in water.

Each pontoon 32 has a front end 68, which is located at or near the bow 22 of the 20 boat 20, and a rear end 70, which is located at or near the stem 24 of the boat 20. In a preferred embodiment, the front end 68 of the body 62 of each pontoon 32 is connectable to a nose cone 72 at a first seam 74. In the illustrated embodiment of FIG. 3, the nose cone 72 has a frustoconical shape, with a truncated front apex 76 and a rear base 78 length of the boat. In a particular preferred embodiment, the pontoon is narrower at the front and wider at the rear end of the pontoon. Hence, the pontoon can accommodate a load distribution that is skewed towards the greater stem of the boat. The pontoon may include a generally cylindrical body that may have an elongated portion cut away or omitted to define an elongated flat wall that is attachable to a lower side of a deck of the boat. A pontoon boat having a non-uniform diameter pontoon is also provided.

2. Construction and Operation of A Preferred Embodiment of the Pontoon Boat

Figure 2:
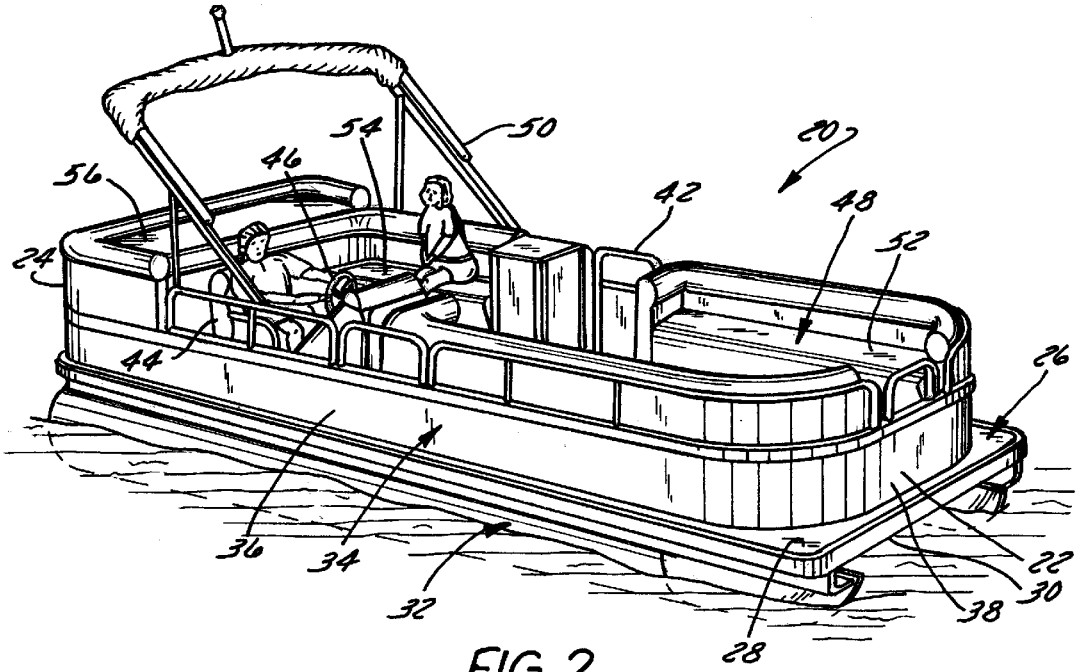
FIG. 2 a perspective view of the pontoon boat of FIG. 1, showing the boat in water with people aboard.
Figure 3:
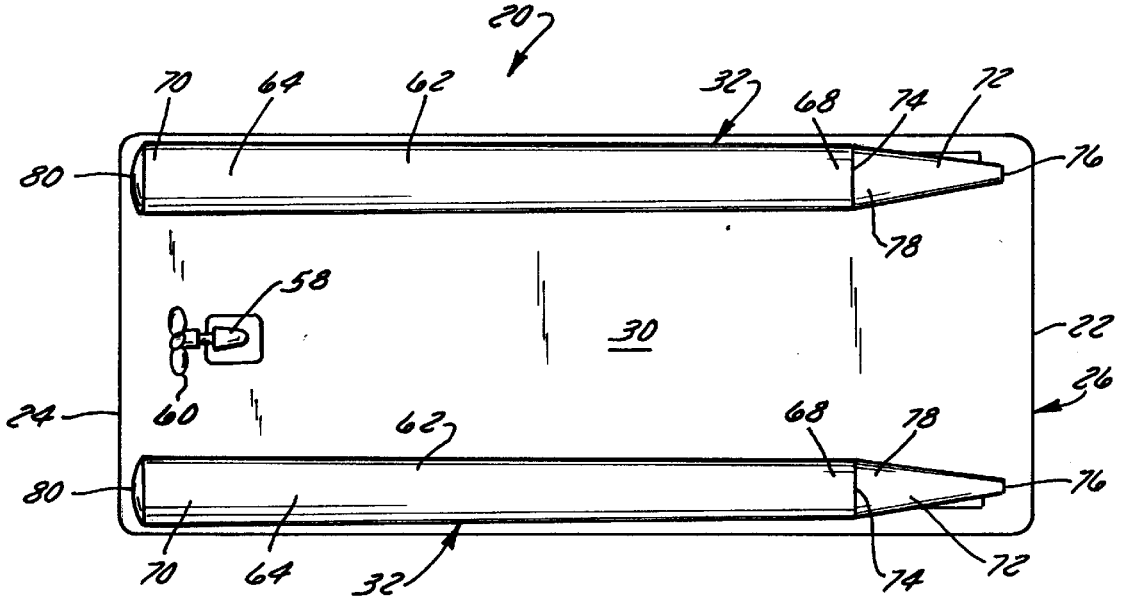
FIG. 3 a bottom plan view of the pontoon boat of FIGS. 1 and 2.

Referring first to FIGS. 1–4, the pontoon boat 20 has a bow 22 and a stem 24. The pontoon boat 20 includes a deck 26 having an upper surface 28 and a lower surface 30. A typical deck 26 is 8 feet wide. Pontoons 32 are attached to the lower surface 30 of the deck 26. As best seen in FIG. 3, rails 34 are attached to the upper surface 28 of the deck 26. In the illustrated embodiment of FIG. 2, the rails 34 include side rails 36 that extend along both longitudinal sides of the pontoon boat 20 and then curve inwardly at the front and rear comers of the deck, a front rail 38, and a rear rail 40. A gate 42 (FIG. 2) is located in one of the side rails 36 for ingress and egress to and from a body of water or a deck. A swim-up ladder (not shown) can also be included, preferably beneath the gate 42.

As is typically the case, fictional components of the boat 20 are concentrated at its stem 24. These components include a captain's chair 44, a steering wheel 46, passenger seating 48 (FIG. 2), and a retractable canopy 50. Passenger seating 48 includes front wrap-around seating 52 and rear wrap-around seating 54, which is adjacent and behind the captain's chair 44. Additionally, the boat 20 in the illustrated embodiment attached to the front end 68 of the body 62. In the illustrated embodiment shown remainder of the figures, the nose cone 72 has a generally tapered front end 77 and a rear base 78. It should be noted that a front end cap (not shown) can be used in place of a nose cone, where desired. Preferably, a diameter of the base 78 of the nose cone 72 is dimensioned such that the nose cone 72 can slide onto or into or otherwise be attached to the front end 68 of the body 62 and be secured thereto at the first seam 74 (FIG. 5). In another preferred embodiment, the body 62 and nose cone 72 are of unitary construction. Typically, the nose cone 72 has a length of about 4 feet. The combined length of the pontoon 32 and the nose cone 72 is typically about 14 feet to about 28 feet long, although the length of the pontoon and nose cone can vary.

The rear end of the body 62 is closed either by an end cap 80 formed integrally with the remainder of the rear end 70 or fitted onto or into the rear end 70 of the body 62 at a second seam (not shown). In the illustrated embodiment, the end cap 80 curves outwardly to reduce friction when the boat 20 moves backwardly. Pontoons 32 are generally watertight, although a drain hole (not shown) is typically provided to release any captured water.

Each body 62 has a cross section with a larger diameter at the rear end 70 than at the front end 68 of the pontoon 32. Preferably, the body 62 has a continual taper. In a preferred embodiment, the mean diameter of the front end 68 of the body 62 is about 19 inches to about 23 inches, and the mean diameter of the rear end 70 of the body 62 is about 27 inches. The dimensions of the body 62 and the nose cone 72 can be selected for several factors. These include, but are not limited to, whether and to what extent people or gear will be concentrated in the stern 24, the weight of the engine 58, and the location and size of the fuel tank(s) (not shown). For example, if the expected load at the bow 22 is low, then the nose cone 72 can have a smaller diameter, such as a 19-inch diameter at its base 78. Where more load is projected to be borne by in the bow 22, the nose cone 72 preferably, has a diameter of about 22 to about 24-inches at the base 78 of the nose cone 72. For a 40 horsepower engine 58, the rear end 70 of the body 62 and the end cap 80 preferably have a diameter of about 24 inches. In contrast, with a 90 horsepower engine 58, a body 62 having a rear end 70 and end cap 80 with a diameter of about 27 inches is preferred.

The body 62 can be of unitary construction or it can be assembled from multiple sections, such as a fore section 82 and an aft section 84 that are attached at a third seam 86, as is shown in FIG. 5. For example, in FIG. 5 where a nose cone 72 having a length L3 of 4 feet can be attached to a fore body section 82 having a length L2 of 5 feet, which in turn is attached to an aft body section having a length L1 of 5 feet to form a 14-foot pontoon 32. The preferred cross-sectional dimensions of a pontoon 32 with multiple sections include a nose cone 72 having a diameter at its base 78 of about 22 inches, which is connected to the fore section 82 of a body 62 having a diameter of about 22 inches at its front and a diameter at its rear of about 24 inches. The aft section 84 of the body 62 has a diameter at its front of about 24 inches and a diameter at its back where the end cap 80 is located of about 27 inches. These diameters provide a nose cone 72 having a width W3 that is smaller than a width W2 of the fore body section 82 that in turn is smaller than a width W3 of the aft body section 84.

In a preferred embodiment, the pontoon 32 is removable from the remainder of the pontoon boat 20 by detachment from the lower surface 30 of the deck 26 in a conventional manner. The removability of pontoon 32 from the remainder of the pontoon boat 20, permits, for example, a boat owner to change the pontoons 32 used on the boat 20 in order, e.g., to accommodate different aggregate loads, or different load distributions.

Because it has a tapered pontoon 32, boat 20 remains generally horizontal even when the load of the boat 20 is concentrated near the stern 24. For example, a pontoon boat 20 carrying 10 people, weighing 1500 pounds, can be kept generally horizontal when all 10 of those people sitting in the stem 24, e.g., with 1 person in the captain's chair 44, 5 people on the sun deck 56, and 4 people in the rear seating 54. Keeping the pontoon boat 20 generally horizontal advantageously smoothes out the ride of the pontoon boat 20. In addition, it avoids submerging the engine 58, which can stall the engine 58 and cause damage thereto.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention. For instance, pontoons 32 of different shapes and orientation, than those described above, could be utilized. The wider portion(s) of the body 62 could also be located at portions other than the stem 24. The body 62 could also be stepped or notched instead of or in addition to being tapered. In addition, the body 62 could also be formed from separate sections that are discontinuous. For example, one or more sections could have a first cross-sectional diameter and one or more other section could have a second cross-sectional diameter that is larger than the first cross-sectional diameter. The invention is not intended to be limited to the preferred embodiments described above, but rather is intended to be limited only by the claims set out below. Thus, the invention encompasses all alternate embodiments that fall literally or equivalently within the scope of these claims.

What is claimed is:

1. A pontoon comprising an elongated body of a non-uniform diameter, the diameter (1) extending at least substantially an entire length of the pontoon and (2) decreasing along at least substantially the entire length thereof from a rear end to a front end thereof, wherein the body is dimensioned and configured to provide non-uniform buoyant force to a boat along at least a majority of a length of a boat, the force being substantially stronger at the rear end of the body than at the front end of the body.

2. A pontoon of claim 1, wherein the front end of the body has a diameter of about 19 inches to about 23 inches.

3. A pontoon of claim 2, wherein the rear end of the body has a diameter of about 27 inches.

4. A pontoon of claim 1, wherein the pontoon comprises:

(A) a nose cone that is connected to the front end of the body; and (B) an end cap that is connected to the rear end of the body.

5. A pontoon of claim 4, wherein a length of the pontoon is about 14 feet to about 28 feet long.

6. A pontoon of claim 4, wherein the nose cone is removably attached to the body.

7. A pontoon of claim 4, wherein the nose cone is integral with the body.

8. A pontoon of claim 1, wherein the body is of unitary construction.

9. A pontoon of claim 1, wherein the body comprises at least two sections connectable at a seam.

10. A pontoon of claim 1, wherein the body comprises sections that are discontinuous.

11. A pontoon boat comprising:

(A) pontoons, wherein each pontoon includes an elongated body of a non-uniform diameter, the diameter (1) extending at least substantially an entire length of the pontoon and (2) decreasing along at least substantially the entire length thereof from a rear end to the front end thereof, wherein the body is configured and dimensioned to provide a non-uniform buoyant force along at least a majority of a length of the pontoon boat, the force being substantially stronger at the rear end of the body than at the front end of the body, and (B) a deck having an upper surface and a lower surface, wherein the pontoons are attached to the lower surface of the deck.

12. A pontoon boat of claim 11, wherein the front end of the body has a diameter of the front end is about 19 inches to about 23 inches.

13. A pontoon boat of claim 12, wherein the rear end of the body has a diameter of about 27 inches.

14. A pontoon boat of claim 11, wherein the pontoon comprises a nose cone that is connected to the front end of the body.

15. A pontoon boat of claim 14, wherein a length of the pontoon is about 14 feet to about 28 feet long.

16. A pontoon boat of claim 14, wherein the nose cone is removably attached to the body.

17. A pontoon boat of claim 14, wherein the nose cone is integral with the body.

18. A pontoon boat of claim 14, wherein the body is of unitary construction.

19. A pontoon boat of claim 14, wherein the body comprises at least two sections connectable at a seam.

20. A pontoon boat of claim 14, wherein the body comprises sections that arc discontinuous.

21. A pontoon boat of claim 11, wherein the rear end of the body terminates substantially adjacent an end of the deck.

22. A pontoon comprising an elongated body of a non-uniform diameter, the diameter (1) extending at least substantially an entire length of the pontoon and (2) decreasing along at least substantially the entire length thereof from a rear and to a front end thereof, wherein the body is dimensioned and configured to provide non-uniform buoyant force to a boat along at least a majority of a length of a boat, the force being substantially stronger at the rear end of the body than at the front end of the body, and wherein along at least a substantial portion of the majority of a length of the pontoon, at least a major portion of a cross-section of the pontoon is curved.

23. A pontoon boat comprising:

(A) pontoons, wherein each pontoon includes an elongated body of a non-uniform diameter, the diameter (1) extending at least substantially an entire length of pontoon and (2) decreasing along at least substantially the entire length thereof from a rear end to a front end thereof, wherein the body is configured and dimensioned to provide a non-uniform buoyant force along at least a majority of a length of the pontoon boat, the force being substantially stronger at the rear end of the body than at the front end of the body, and wherein along at least a substantial portion of the length of the pontoon, at least a major portion of a cross-section of the pontoon is curved; and (B) a deck having an upper surface and a lower surface, wherein the pontoons are attached to the lower surface of the deck.

* * * * *

UNITED STATES PATENT AND TRADEMARK OFFICE

CERTIFICATE OF CORRECTION

PATENT NO. : 6,598,552 B1
DATED : July 29, 2003
INVENTOR(S) : Richard W. Rouse

It is certified that error appears in the above-identified patent and that said Letters Patent is hereby corrected as shown below:

Column 2,
Lines 1 and 14, “stem” should read -- stern --;
Line 64, beginning with “includes a raised sun deck 56 behind” through column 3, ending with “apex 76 and rear base 78” should be moved to col. 3, line 64, after “embodiment”.

Column 3,
Lines 11, 25, 34 and 44, “stem” should read -- stern --;
Line 57, “fictional” should read -- functional --.

Column 5,
Lines 6 and 20, “stem” should read -- stern --.
Line 40, after “vide” insert -- a --.

Column 6,
Line 13, delete “the front end is”;
Line 41, after “vide” insert -- a --;
Line 51, after “of” insert -- the --.

Signed and Sealed this

Eighteenth Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,598,552 B1
DATED : July 29, 2003
INVENTOR(S) : Richard W. Rouse

It is certified that error appears in the above-identified patent and that said Letters Patent is hereby corrected as shown below:

Delete specification cols. 1-6 and substitute therefore the specification cols. 1-6 as shown on the attached pages.

Signed and Sealed this

Fourth Day of January, 2005

JON W. DUDAS
*Director of the United States Patent and Trademark Office*

PONTOON HAVING A CROSS SECTION WITH A NON-UNIFORM DIAMETER AND BOAT HAVING SAME

BACKGROUND OF THE INVENTION

1. Field of the Invention

The invention relates to floatation devices, and more particularly to pontoons for floating boats and boats having pontoons.

2. Description of the Related Art

Boats are used for a variety of purposes, including recreation, transportation, fishing, camping, and socializing. Pontoon boats are popular for these uses and are preferred by some boaters because of their relative stability and their capacity to accommodate many people.

Pontoon boats have a keel, which is a main structural member that runs lengthwise along a centerline from a bow portion (front) to a stern portion (rear) of the boat. Pontoon boats normally have a shallow draft. That is, the depth of the keel of the pontoon boat below the water line is shallow. In addition, pontoon boats typically include a generally flat deck that is supported on airtight floatation tubes, i.e., pontoons. A nose cone is located at the front of the pontoon to help the boat glide forwardly through water. Conventional pontoons have a cross section with a fixed diameter. As a result, the pontoon's load supporting capacity is constant along the length of the pontoon. Pontoons with fixed-diameter cross sections therefore can keep a pontoon boat afloat in a generally horizontal orientation if the weight of the boat and its occupants are relatively equally distributed along the length of the pontoon.

The deck supports furniture, engine, fuel, and often additional items such as fishing equipment, coolers. The engine, typically comprising a relatively heavy 75 to 115 horsepower engine, is mounted on or near the stern of the boat. The fuel tank, often weighing several hundred pounds when full, is usually located near the engine. Therefore, even without including passengers, the majority of the weight is concentrated in the back of the boat.

Pontoon boats usually include seating for multiple passengers. This seating is typically concentrated at the stern. The suggested maximum number of persons for a typical 18-foot boat is 8 people, with a maximum of 12 people on a typical 22-foot boat. Considering that an average person weighs about 150 pounds, eight people, on average, weigh 1,200 pounds and twelve people, on average, weigh 1,800 pounds. The maximum weight capacity for a typical 18-foot boat is 1,900 pounds, for a typical 20-foot boat, is 2,155 pounds, and for a typical 22-foot boat is 2,400 pounds. Although the weight of the people alone can be carried by these boats, it is difficult for a pontoon boat to accommodate this weight when it is concentrated in one area of the boat. In particular, it is difficult for a pontoon boat to support many people at the stern, where people tend to congregate both because of the design of the boat and because the ride tends to be smoother at the stern. Many boats include a table along with seating at the stern, and many people prefer to sit around a table. Having people assemble at the stern places the majority of the load at the stern. As discussed above, this load concentration near the stern is compounded by the fact that weight of the engine, furniture, and fuel, which are also at the stern, must also be borne by it. In addition, the captain's chair is at the rear of the boat. When enough weight is loaded at the stern, a conventional pontoon boat no longer rides generally horizontally in the water. Instead, the boat lifts toward the stern. This causes several problems. For instance, the ride becomes rougher when the bow is further out of the water. In addition, lifting of the boat makes it difficult to stand or walk. Items may also slide off tables or shelves. Additionally, when the lift towards the stern is extreme, the engine can become submerged, causing failure of the engine.

Thus, there is a need for a pontoon that avoids at least some of the problems noted above. In particular, the pontoon should compensate for uneven load distribution along the length of the boat. The pontoon preferably should also be retrofitable onto an existing boat. Furthermore, there is a need for a boat having pontoons that compensate for greater weight in the stern of the boat.

SUMMARY OF THE INVENTION

The invention, which is defined by the claims set out at the end of this disclosure, is intended to solve at least some of the problems noted above.

In accordance with a first aspect of the invention, a pontoon is provided. The pontoon includes an elongated body of non-uniform diameter. The body is dimensioned and configured to provide a non-uniform buoyant force along at least a majority of a length of a boat in order to accommodate an uneven load distribution on the boat.

In one preferred embodiment, the body has a front end and a rear end, and the body is tapered in cross-sectional diameter along at least a substantial portion of the length thereof. The pontoon may include a generally cylindrical body that may have an elongated portion cut away or omitted to define an elongated flat wall that is attachable to a lower side of a deck of the boat.

Also provided is a pontoon boat that includes the pontoons having an elongated body of non-uniform diameter. The pontoon boat also includes a generally flat deck having an upper surface and a lower side. The pontoons are attached to the lower surface of the deck.

BRIEF DESCRIPTION OF THE DRAWINGS

FIG. 1 a side elevation view of a boat made in accordance with a preferred embodiment of the invention;

FIG. 2 a perspective view of the pontoon boat of FIG. 1, showing the boat in water with people aboard;

FIG. 3 a bottom plan view of the pontoon boat of FIGS. 1 and 2;

FIG. 4 is an exploded view of the pontoon boat for FIGS. 1–3, showing the pontoon detached from the boat;

FIG. 5 is a side elevation view of a pontoon made in accordance with another preferred embodiment of the invention, showing a nose cone, a fore-section, and an aft section of the pontoon.

DETAILED DESCRIPTION OF THE PREFERRED EMBODIMENT

1. Resume

Pursuant to a preferred embodiment of the invention, a pontoon is provided that is tapered. The pontoon has a cross section with a smaller diameter at one portion of the pontoon than another portion in order to accommodate uneven load distribution along the length of the boat. In a particular preferred embodiment, the pontoon is narrower at the front and wider at the rear end of the pontoon. Hence, the pontoon can accommodate a load distribution that is skewed towards the greater stern of the boat. The pontoon may include a generally cylindrical body that may have an elongated portion cut away or omitted to define an elongated flat wall that is attachable to a lower side of a deck of the boat. A pontoon boat having a non-uniform diameter pontoon is also provided.

2. Construction and Operation of a Preferred Embodiment of the Pontoon Boat

Referring first to FIGS. 1–4, the pontoon boat 20 has a bow 22 and a stern 24. The pontoon boat 20 includes a deck 26 having an upper surface 28 and a lower surface 30. A typical deck 26 is 8 feet wide. Pontoons 32 are attached to the lower surface 30 of the deck 26. As best seen in FIG. 3, rails 34 are attached to the upper surface 28 of the deck 26. In the illustrated embodiment of FIG. 2, the rails 34 include side rails 36 that extend along both longitudinal sides of the pontoon boat 20 and then curve inwardly at the front and rear corners of the deck, a front rail 38, and a rear rail 40. A gate 42 (FIG. 2) is located in one of the side rails 36 for ingress and egress to and from a body of water or a deck. A swim-up ladder (not shown) can also be included, preferably beneath the gate 42.

As is typically the case, functional components of the boat 20 are concentrated at its stern 24. These components include a captain's chair 44, a steering wheel 46, passenger seating 48 (FIG. 2), and a retractable canopy 50. Passenger seating 48 includes front wrap-around seating 52 and rear wrap-around seating 54, which is adjacent and behind the captain's chair 44. Additionally, the boat 20 in the illustrated embodiment includes a raised sun deck 56 behind the captain's chair 44 for sitting or lying in the sun. Finally, an engine 58 is mounted on the stern 24 of the boat 20 and supplies power to a propeller 60.

Two pontoons 32 are provided in the illustrated embodiment, oriented generally parallel to one another and extending longitudinally of the boat 20. One or more additional pontoons 32 can be added. For example, a third pontoon 32 can be added between two pontoons 32, which can be located along outer sides of the boat 20. Pontoons 32 may be fabricated from a material such as aluminum or any other material commonly used in pontoons. Each pontoon 32 has a non-uniform diameter so as to have greater load bearing capacity at the portion(s) of the boat 20 where the load is more heavily distributed. That portion is the stern 24 in the illustrated embodiment. In a preferred embodiment, each pontoon 32 includes an elongated body 62 having a lower wall 64 that is partially cylindrical in shape and an upper wall 66 that is generally flat, as is best seen in FIGS. 4 and 5. The body 62 is dimensioned and configured to provide variable buoyant force to a boat 20 along at least a majority of a length of the boat. Each pontoon 32 is attached to the lower surface 30 of the deck 26 at the generally flat, upper wall 66 of the body 62. When the pontoon boat 20 is in use, at least a portion of the partially cylindrical, lower wall 64 is submerged in water.

Each pontoon 32 has a front end 68, which is located at or near the bow 22 of the boat 20, and a rear end 70, which is located at or near the stern 24 of the boat 20. In a preferred embodiment, the front end 68 of the body 62 of each pontoon 32 is connectable to a nose cone 72 at a first seam 74. In the illustrated embodiment of FIG. 3, the nose cone 72 has a frustoconical shape, with a truncated front apex 76 and a rear base 78 attached to the front end 68 of the body 62. In the illustrated embodiment shown remainder of the figures, the nose cone 72 has a generally tapered front end 77 and a rear base 78. It should be noted that a front end cap (not shown) can be used in place of a nose cone, where desired. Preferably, a diameter of the base 78 of the nose cone 72 is dimensioned such that the nose cone 72 can slide onto or into or otherwise be attached to the front end 68 of the body 62 and be secured thereto at the first seam 74 (FIG. 5). In another preferred embodiment, the body 62 and nose cone 72 are of unitary construction. Typically, the nose cone 72 has a length of about 4 feet. The combined length of the pontoon 32 and the nose cone 72 is typically about 14 feet to about 28 feet long, although the length of the pontoon and nose cone can vary.

The rear end of the body 62 is closed either by an end cap 80 formed integrally with the remainder of the rear end 70 or fitted onto or into the rear end 70 of the body 62 at a second seam (not shown). In the illustrated embodiment, the end cap 80 curves outwardly to reduce friction when the boat 20 moves backwardly. Pontoons 32 are generally watertight, although a drain hole (not shown) is typically provided to release any captured water.

Each body 62 has a cross section with a larger diameter at the rear end 70 than at the front end 68 of the pontoon 32. Preferably, the body 62 has a continual taper. In a preferred embodiment, the mean diameter of the front end 68 of the body 62 is about 19 inches to about 23 inches, and the mean diameter of the rear end 70 of the body 62 is about 27 inches. The dimensions of the body 62 and the nose cone 72 can be selected for several factors. These include, but are not limited to, whether and to what extent people or gear will be concentrated in the stern 24, the weight of the engine 58, and the location and size of the fuel tank(s) (not shown). For example, if the expected load at the bow 22 is low, then the nose cone 72 can have a smaller diameter, such as a 19-inch diameter at its base 78. Where more load is projected to be borne by in the bow 22, the nose cone 72 preferably, has a diameter of about 22 to about 24-inches at the base 78 of the nose cone 72. For a 40 horsepower engine 58, the rear end 70 of the body 62 and the end cap 80 preferably have a diameter of about 24 inches. In contrast, with a 90 horsepower engine 58, a body 62 having a rear end 70 and end cap 80 with a diameter of about 27 inches is preferred.

The body 62 can be of unitary construction or it can be assembled from multiple sections, such as a fore section 82 and an aft section 84 that are attached at a third seam 86, as is shown in FIG. 5. For example, in FIG. 5 where a nose cone 72 having a length L3 of 4 feet can be attached to a fore body section 82 having a length L2 of 5 feet, which in turn is attached to an aft body section having a length L1 of 5 feet to form a 14-foot pontoon 32. The preferred cross-sectional dimensions of a pontoon 32 with multiple sections include a nose cone 72 having a diameter at its base 78 of about 22 inches, which is connected to the fore section 82 of a body 62 having a diameter of about 22 inches at its front and a diameter at its rear of about 24 inches. The aft section 84 of the body 62 has a diameter at its front of about 24 inches and a diameter at its back where the end cap 80 is located of about 27 inches. These diameters provide a nose cone 72 having a width W3 that is smaller than a width W2 of the fore body section 82 that in turn is smaller than a width W3 of the aft body section 84.

In a preferred embodiment, the pontoon 32 is removable from the remainder of the pontoon boat 20 by detachment from the lower surface 30 of the deck 26 in a conventional manner. The removability of pontoon 32 from the remainder of the pontoon boat 20, permits, for example, a boat owner to change the pontoons 32 used on the boat 20 in order, e.g., to accommodate different aggregate loads, or different load distributions.

Because it has a tapered pontoon 32, boat 20 remains generally horizontal even when the load of the boat 20 is concentrated near the stern 24. For example, a pontoon boat 20 carrying 10 people, weighing 1500 pounds, can be kept generally horizontal when all 10 of those people sitting in the stern 24, e.g., with 1 person in the captain's chair 44, 5 people on the sun deck 56, and 4 people in the rear seating 54. Keeping the pontoon boat 20 generally horizontal advantageously smoothes out the ride of the pontoon boat 20. In addition, it avoids submerging the engine 58, which can stall the engine 58 and cause damage thereto.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention. For instance, pontoons 32 of different shapes and orientation, than those described above, could be utilized. The wider portion(s) of the body 62 could also be located at portions other than the stern 24. The body 62 could also be stepped or notched instead of or in addition to being tapered. In addition, the body 62 could also be formed from separate sections that are discontinuous. For example, one or more sections could have a first cross-sectional diameter and one or more other section could have a second cross-sectional diameter that is larger than the first cross-sectional diameter. The invention is not intended to be limited to the preferred embodiments described above, but rather is intended to be limited only by the claims set out below. Thus, the invention encompasses all alternate embodiments that fall literally or equivalently within the scope of these claims.

What is claimed is:

1. A pontoon comprising an elongated body of a non-uniform diameter, the diameter (1) extending at least substantially an entire length of the pontoon and (2) decreasing along at least substantially the entire length thereof from a rear end to a front end thereof, wherein in the body is dimensioned and configured to provide a non-uniform buoyant force to a boat along at least a majority of a length of a boat, the force being substantially stronger at the rear end of the body than at the front end of the body.

2. A pontoon of claim 1, wherein the front end of the body has a diameter of about 19 inches to about 23 inches.

3. A pontoon of claim 2, wherein the rear end of the body has a diameter of about 27 inches.

4. A pontoon of claim 1, wherein the pontoon comprises:

(A) a nose cone that is connected to the front end of the body; and (B) an end cap that is connected to the rear end of the body.

5. A pontoon of claim 4, wherein a length of the pontoon is about 14 feet to about 28 feet long.

6. A pontoon of claim 4, wherein the nose cone is removably attached to the body.

7. A pontoon of claim 4, wherein the nose cone is integral with the body.

8. A pontoon of claim 1, wherein the body is of unitary construction.

9. A pontoon of claim 1, wherein the body comprises at least two sections connectable at a seam.

10. A pontoon of claim 1, wherein the body comprises sections that are discontinuous.

11. A pontoon boat comprising:

(A) pontoons, wherein each pontoon includes an elongated body of a non-uniform diameter, the diameter (1) extending at least substantially an entire length of the pontoon and (2) decreasing along at least substantially the entire length thereof from a rear end to the front end thereof, wherein the body is configured and dimensioned to provide a non-uniform buoyant force along at least a majority of a length of the pontoon boat, the force being substantially stronger at the rear end of the body than at the front end of the body; and (B) a deck having an upper surface and a lower surface, wherein the pontoons are attached to the lower surface of the deck.

12. A pontoon boat of claim 11, wherein the front end of the body has a diameter of about 19 inches to about 23 inches.

13. A pontoon boat of claim 12, wherein the rear end of the body has a diameter of about 27 inches.

14. A pontoon boat of claim 11, wherein the pontoon comprises a nose cone that is connected to the front end of the body.

15. A pontoon boat of claim 14, wherein a length of the pontoon is about 14 feet to about 28 feet long.

16. A pontoon boat of claim 14, wherein the nose cone is removably attached to the body.

17. A pontoon boat of claim 14, wherein the nose cone is integral with the body.

18. A pontoon boat of claim 14, wherein the body is of unitary construction.

19. A pontoon boat of claim 14, wherein the body comprises at least two sections connectable at a seam.

20. A pontoon boat of claim 14, wherein the body comprises sections that are discontinuous.

21. A pontoon boat of claim 11, wherein the rear end of the body terminates substantially adjacent an end of the deck.

22. A pontoon comprising an elongated body of a non-uniform diameter, the diameter (1) extending at least substantially an entire length of the pontoon and (2) decreasing along at least substantially the entire length thereof from a rear end to a front end thereof, wherein the body is dimensioned and configured to provide a non-uniform buoyant force to a boat along at least a majority of a length of a boat, the force being substantially stronger at the rear end of the body than at the front end of the body, and wherein along at least a substantial portion of the majority of a length of the pontoon, at least a major portion of a cross-section of the pontoon is curved.

23. A pontoon boat comprising:

(A) pontoons, wherein each pontoon includes an elongated body of a non-uniform diameter, the diamieter (1) extending at least substantially an entire length of the pontoon and (2) decreasing along at least substantially the entire length thereof from a rear end to a front end thereof, wherein the body is configured and dimensioned to provide a non-uniform buoyant force along at least a majority of a length of the pontoon boat, the force being substantially stronger at the rear end of the body than at the front end of the body, and wherein along at least a substantial portion of the length of the pontoon, at least a major portion of a cross-section of the pontoon is curved; and (B) a deck having an upper surface and a lower surface, wherein the pontoons are attached to the lower surface of the deck.

* * * * *